US005759081A

United States Patent [19]

Lyman

[11] Patent Number: 5,759,081

[45] Date of Patent: *Jun. 2, 1998

[54] TOY CONSTRUCTION SET FEATURING GEARS AND RADIANT CONNECTORS

[76] Inventor: Ronald Lee Lyman, P.O. Box 2786, Roseville, Calif. 95746-2786

[ * ] Notice: The term of this patent shall not extend beyond the expiration date of Pat. No. 5,259,803.

[21] Appl. No.: 148,939

[22] Filed: Nov. 8, 1993

Related U.S. Application Data

[63] Continuation of Ser. No. 682,730, Apr. 9, 1991, Pat. No. 5,259,803.

[51] Int. Cl.[6] ..... A63H 33/12; G09B 25/00

[52] U.S. Cl. ..... 446/103; 434/401; 74/434; 74/412 R

[58] Field of Search ..... 446/102, 103, 446/104, 105, 108, 116, 120, 121, 122, 123, 124, 125, 128, 85, 86; 434/302, 401; 74/434, 431, 412 R, 420, 459

[56] References Cited

U.S. PATENT DOCUMENTS

| | | | |
|---|---|---|---|
| 930,364 | 8/1909 | Edwards | 74/420 |
| 941,318 | 11/1909 | Grant | 74/420 |
| 1,295,945 | 4/1919 | Riter | 74/420 |
| 3,172,666 | 3/1965 | Ryan | 446/103 X |
| 3,193,293 | 7/1965 | Shaper | 446/103 X |
| 3,233,358 | 2/1966 | Dehm | 446/102 |
| 3,461,601 | 8/1969 | Kristiansen | 446/103 |
| 3,486,269 | 12/1969 | Fischer | 446/103 |
| 4,037,978 | 7/1977 | Connelly | 446/116 X |

FOREIGN PATENT DOCUMENTS

| | | | |
|---|---|---|---|
| 0104716 | 4/1984 | European Pat. Off. | 446/103 |
| 4212492 | 10/1992 | Germany | 446/128 |

*Primary Examiner*—D Neal Muir
*Attorney, Agent, or Firm*—Bernhard Kreten

[57] ABSTRACT

A round wafer-shaped gear block is provided with beveled gear teeth along a side wall of the gear block. The gear block has posts on a top surface and has a hub integrally formed on a bottom surface thereof. The hub is rotationally receivable within orifices of a support block. The gear blocks may be attached to an assemblage of support blocks in an interfacing pattern allowing a user to construct representations of both planar gear pairs and beveled gear pairs.

5 Claims, 3 Drawing Sheets

TOY CONSTRUCTION SET FEATURING GEARS AND RADIANT CONNECTORS

CROSS REFERENCE TO RELATED APPLICATION

This application is a continuation of application Ser. No. 07/682,730, filed Apr. 9, 1991.

FIELD OF THE INVENTION

The following invention relates generally to an instrumentality for creating objects of amusement for children formed from a plurality of building blocks. The blocks are interconnected such that they stimulate a child's imagination and creativity to form structures and more specifically, structures which include interfacing gears rotating in a variety of distinct planes.

BACKGROUND OF THE INVENTION

The instant invention reflects an ongoing evolution of structure, disclosed in U.S. Pat. No. 5,022,885 and U.S. Pat. No. 5,104,345, to the instant inventor.

The prior art is relatively rich in attempts at providing construction blocks for children which challenge the child's imagination yet are not so complex as to frustrate the child in his creative endeavors. Not surprisingly, many known patents can be grouped into the above noted objection categories as being either too simple or too complex.

The following patents reflect the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | U.S. Pat. No. | ISSUE DATE |
|---|---|---|
| Schmetzer | 171,533 | December 28, 1875 |
| Arold | 419,099 | January 7, 1890 |
| Lewis | 1,405,851 | February 7, 1922 |
| Hultman | 1,554,095 | September 15, 1925 |
| Limited, et al. | BR413,963 | July 26, 1934 |
| Levy, et al. | GB459,452 | February 4, 1937 |
| Levy, et al. | AU100,283 | February 25, 1937 |
| Andre | 2,649,803 | August 25, 1953 |
| McKee | 2,708,329 | May 17, 1955 |
| Aureillan | BR740,951 | November 23, 1955 |
| Bauspielzeug | AU184,497 | January 25, 1956 |
| Zimmerman | 2,776,521 | January 8, 1957 |
| Skelli-Cohen | FR1.144.481 | October 14, 1957 |
| Techni-Plaste | FR1.149.918 | January 3, 1958 |
| La Grutta | 2,972,833 | February 28, 1961 |
| Christiansen | 3,005,282 | October 24, 1961 |
| Amsler | 3,032,919 | May 18, 1962 |
| Mino-Gaillard | FR1,311,992 | November 5, 1962 |
| Berco Lux | BR976,761 | December 2, 1964 |
| Christiansen | 3,162,973 | December 29, 1964 |
| Ryan | 3,172,666 | March 9, 1965 |
| W. H. Schaper | 3,193,293 | July 6, 1965 |
| Onanian | 3,195,266 | July 20, 1965 |
| Onanian | 3,205,611 | September 14, 1965 |
| Litzka | 3,206,888 | September 21, 1965 |
| Wright, et al. | 3,224,135 | 1965 |
| Hasel | BR1,008,459 | October 27, 1965 |
| J. Dehm | 3,233,358 | February 8, 1966 |
| Christiansen | 3,242,610 | March 29, 1966 |
| C. T. Troy | 3,374,917 | March 26, 1968 |
| Stubbmann | 3,392,480 | July 16, 1968 |

-continued

| INVENTOR | U.S. Pat. No. | ISSUE DATE |
|---|---|---|
| Shackelton | BR1,212,537 | 1969 |
| K. M. Kristiansen | 3,461,601 | August 19, 1969 |
| Playcraft Toys, Inc. | BR1,167,678 | October 22, 1969 |
| A. Fischer | 3,486,269 | December 30, 1969 |
| Sloop, et al. | 3,496,670 | February 24, 1970 |
| Trendon Limited | BR1,240,878 | July 28, 1971 |
| Heubl | 3,603,025 | September 7, 1971 |
| Kishigami | 3,603,026 | September 7, 1971 |
| Zimmerman | 3,604,145 | September 14, 1971 |
| Matsubayashi, et al. | 3,624,955 | December 7, 1971 |
| Schmidt | 3,699,709 | October 24, 1972 |
| Nagasaka | 3,740,895 | June 26, 1973 |
| Baer | 3,777,393 | December 11, 1973 |
| Hancovsky | 3,780,469 | December 25, 1973 |
| Bakker | DT 24 29 491 | January 16, 1975 |
| Retzler & Knight | BR1,382,134 | January 29, 1975 |
| Lange | 3,867,784 | February 25, 1975 |
| Crawley | 3,894,354 | July 15, 1975 |
| Fabre | 3,895,456 | July 22, 1975 |
| Den Ouden | 3,965,610 | June 29, 1976 |
| Much | 3,975,858 | August 24, 1976 |
| Maddestra et al. | 4,003,144 | January 18, 1977 |
| Burge | DT 26 37 136 | March 3, 1977 |
| Harvey | 4,055,019 | October 25, 1977 |
| Osterried | 4,080,742 | March 28, 1978 |
| Cioptia | DE 24 46 475 | May 3, 1978 |
| Hake | 4,090,322 | May 23, 1978 |
| Kristiansen | 4,185,410 | January 29, 1980 |
| Knudsen | 4,214,403 | July 29, 1980 |
| Chatani | 4,246,718 | January 27, 1981 |
| Mayr | 4,253,268 | March 3, 1981 |
| Davis | 4,257,207 | March 24, 1981 |
| Xanthopoulos, et al. | 4,270,303 | June 2, 1981 |
| Chatani | 4,305,221 | December 15, 1981 |
| Chatani, et al. | 4,306,373 | December 22, 1981 |
| Chatani, et al. | Des. 272,167 | January 10, 1984 |
| Chatani, et al. | Des. 272,256 | January 17, 1984 |
| Lin | EP-104-716-A1 | April 4, 1984 |
| Bersani | FR2534-481-A | April 20, 1984 |
| Inskip | EP-109-181-A | May 23, 1984 |
| Meyer | 4,522,001 | June 11, 1985 |
| Meyer | DE 35 02 146 A1 | August 1, 1985 |
| Labelle | 4,547,160 | October 15, 1985 |
| Bolli | 4,552,541 | November 12, 1985 |
| Lyman | 4,606,732 | August 19, 1986 |
| Yoke | 4,642,064 | February 10, 1987 |
| Ziegler | 4,731,041 | March 15, 1988 |
| Knudsen | Des. 296,342 | June 21, 1988 |
| Lyman | 4,764,144 | August 16, 1988 |
| Lyman | 4,789,369 | December 6, 1988 |
| Svagerko | 4,792,319 | December 20, 1988 |
| Furukawa et al. | 4,813,903 | March 21, 1989 |
| Heiremans | WO-89/00069 | January 12, 1989 |
| Blickle | 4,932,916 | June 12, 1990 |
| Brandstätter | DE 3900816 A1 | July 19, 1990 |
| Lyman | 5,022,885 | June 11, 1991 |
| Klitsner et al. | 5,073,138 | December 17, 1991 |

OTHER PRIOR ART (Including Author, Title, Date, Pertinent Pages, Etc.)

Lego Group, 8849 Technic (visual display), 1986
Lego Group, Legoland 6039, advertisement/brochure, 1988
Lego Group, Advertisement, 1989
Lego Group, Lego Catalogue, 1989
Discovery Toys, Fall & Winter 1990, Cover page & 18–19 Crosswise The patent to Lin teaches the use of a modular toy assembly which includes frames, functional units and a set of interchangeable gears. The gear members include both beveled gearing teeth and spur gearing teeth. The building block of this application is distinguishable from the teaching of Lin in that a hub rotationally supporting the gear block of this invention is integrally formed with the block rather than being an independent structure to which the block is attached, inter alia.

The patent to Klitsner teaches the use of a modular gear and frame toy which includes a gear block which can interact with other gear blocks. The building block of this application is distinct from the teachings of Klitsner in that it includes a beveled surface on the gears to facilitate effective reproduction of beveled gear action. Furthermore, the building block of this invention includes a hub which is integrally formed with the entire building block, rather than being a separate structure as is taught by Klitsner.

The remainder of the prior art listed above further show the state of the art of which applicant is aware. Each of these references is also distinguishable from the applicant's invention because the instant invention diverges more starkly from their teachings.

SUMMARY OF THE INVENTION

Gear blocks are provided which are directly supportable upon support blocks. The gear blocks assume a substantially wafer-like configuration having a top surface and a bottom surface. The top surface of each gear block is similar to the top surface of each support block. This top surface includes posts which extend upwardly therefrom and can connect to portions of other blocks including the bottom of the support blocks.

The bottom surface of each gear block has a hub which is a hollow cylindrical construct extending downward perpendicularly from the bottom surface of the gear block. The gear blocks have one curved side edge making the gear blocks substantially circular in cross-section. Along the side edges of the gear blocks are formed a plurality of beveled gear teeth. These gear teeth allow pairs of gear blocks to interface in a rotational manner, with one gear block being able to cause the other gear block to rotate. The gear teeth of the gear blocks are beveled to allow the pairs of gear blocks to be oriented with their top surfaces in planes not parallel with each other, thus forming a beveled gear pair.

A plurality of support blocks may be connected together along side surfaces thereof, or along top and a bottom surfaces thereof, and then a plurality of gear blocks may connect to the assembly of support blocks by placing the hubs of the gear blocks within the orifices of the support blocks. When configured in this way, the gear blocks may interface with each other such that when one gear block is rotated, the entire set of interconnecting gear blocks may all rotate. The bottom surface or the prominence of the support blocks may connect to the top surface of the gear blocks. This allows a support block to rotate upon the top surface of the gear block providing a handle by which a user may more easily apply an input rotational force to the system of gear blocks.

Succinctly stated, the instant invention spans the spectrum of complexity from a most simple toy to a most demanding, complex and creative toy to accommodate the interest pattern and skill level of the widest cross-section of children and adults. The blocks themselves are capable of interconnection on all surfaces and also are capable of overlapping with adjacent blocks in a number of patterns. The blocks themselves are also both optically ornate and of complex contour to provide both a visual and tactile stimulus.

OBJECTS OF THE INVENTION

Accordingly, it is a primary object of the present invention to provide a novel and useful construction toy set.

A further object of the present invention is to provide a device as characterized above which is extremely simple to use thereby appealing to users having a modest skill level but also capable of manipulation by extremely creative people thereby spanning a broad spectrum in maintaining interest of users.

A further object of the present invention is to provide a device as characterized above which is both visually and tactilely stimulating.

It is yet a further object of the present invention to provide a device as characterized above which is extremely durable in construction, safe to use and lends itself to mass production techniques.

A further object of the present invention is to provide a device as characterized above which is dimensioned such that even young children can safely play with blocks forming the construction toy set.

A further object of the present invention is to provide a device as characterized above where blocks can be interconnected in a multiplicity of ways, thereby promulgating creativity and providing an extremely large number of possible structures buildable with this construction set.

A further object of the present invention is to provide a device as characterized above where gear shaped blocks may interface together through gear teeth thereon, simulating the action of planar gears in a construction toy set.

A further object of the present invention to provide a device as characterized above where beveled gear shaped blocks may interface in nonparallel planes simulating the action of beveled gears in a construction toy set.

Viewed from a first vantage point, it is an object of the present invention to provide a construction toy comprised of a plurality of construction blocks having multiple facets, said construction blocks including a gear block, one said facet on one said gear block having gear teeth with means to mesh both in a planar fashion and an orthogonal fashion with gear teeth on another said gear block having similar meshing means, said gear block rotatable about an axial geometric center of said gear block, and means for retarding axial translation of said gear block along said axial geometric center, said means for retarding axial translation including a cylindrical hub integrally formed with said gear block, and extending axially from an axial geometric center of said gear block.

Viewed from a second vantage point, it is an object of the present invention to provide a toy gear block for use by a child in learning the mechanical operation of gears, the gear block formed from a unitary substantially ridged mass and comprised of a circular top surface, a circular bottom surface substantially parallel to and spaced from the top surface, a side surface interposed between said top surface and said bottom surface, said side surface including a plurality of gear teeth thereon, and a hub integrally formed with said gear block and extending substantially perpendicularly from said top surface and said bottom surface at a geometric center of said gear block.

Viewed from a third vantage point, it is an object of the present invention to provide a plurality of similar beveled gear blocks configured to interact while rotationally supported upon adjacent facets of a reflex angle of a structure, the interaction resulting in rotation of one block being transferred to an adjacent block, each gear block comprised of a support surface including a means to rotationally support said gear block upon a facet of the structure, and a plurality of gear teeth on a side surface adjacent said support surface, said gear teeth including a beveled surface thereon, said beveled surface adjacent said support surface and diverging from a plane including said support surface by an angle less than 90 degrees.

These and other objects will be made manifest when considering the following detailed specification when taken in conjunction with the appended drawing figures.

DESCRIPTION OF PREFERRED EMBODIMENTS

Figure 11:
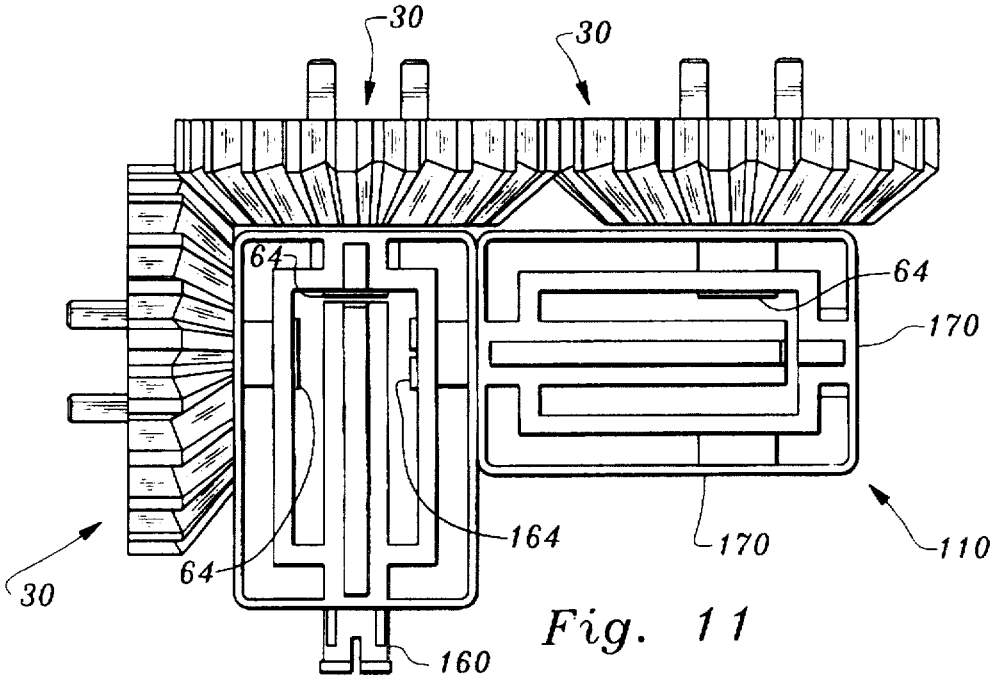
FIG. 11 is a bottom view of two support blocks connected together with three gear blocks rotatably supported thereon and with gear teeth thereof enmeshed together to illustrate both beveled gear operation and spur gear operation.

Referring to the drawings, wherein like reference numerals represent like parts throughout, reference numeral 30 is directed to a gear block, shown in detail in FIGS. 1 through 4. In essence, the gear block 30 is substantially a wafer-shaped construct having a top surface 31, a bottom support surface 32 and a side surface 33. The top surface 31 has a plurality of posts 40 extending upwardly therefrom. The bottom surface 32 has a hub 60 integrally formed therewith and projecting normally therefrom at a geometric center thereof. The side surface 33 has a plurality of beveled gear teeth 34 integrally formed therewith. The posts 40 are configured to fasten within channels 150 of a support block 110 (FIGS. 7 through 11). The hub 60 is configured to fasten within orifices 170 of the support blocks 110 allowing a plurality of gear blocks 30 to be attached to support blocks 110 in a variety of ways, some of which are shown in FIG. 11.

More particularly, and with reference to FIGS. 1 through 4, the gear block 30 includes a top surface 31 and a bottom surface 32 which define two facets parallel to each other and which respectively define first and second attachment surfaces. An attachment means of the top surface 31 is the plurality of posts 40, preferably square in cross-section and configured in linear rows 42 that extend across the top surface 31. Each post 40 is a substantially tetragonal construct integrally formed via a first square end 41 to the top surface 31 and extending upwardly perpendicular to the top surface 31.

Each post 40 terminates at a second end 41 above the top surface 31. Four sidewalls 45 preferably extend out from the gear block 30 from the first end 43 near the bottom surface 32 to the second end 41. The sidewalls 45 provide the posts 40 with a width similar to a width of the channels 150 of the support blocks 110. Thus, the posts 40 can be connected within the channels 150, binding a support block 110 to the top surface 31 of the gear block 30. The second end 41 includes a bevel 44 around a perimeter thereof which facilitates location of the posts 40 within the channels 150. Preferably, the gear blocks 30 have two rows 42 of posts 40 with each row 42 being parallel to adjacent rows 42. Preferably, each row 42 has three posts 40.

The posts 40 are located a distance apart from each other which allows a support block 110 to connect to a gear block 30 in various rotationally distinct top-to-bottom configurations. When configured in this way, posts 40 from the same row 42 of the gear block 30, or a support block, may attach within separate channels 150 of an adjoining support block 110.

The top surface 31 of the gear block 30 includes a variety of different structures. A circular floor 31*a* forms a center of the top surface 31. The circular floor 31*a* is a circular planar surface concentric with an axial geometric center of the gear block 30. An edge of the circular floor 31*a* connects to a frustoconical slope 31*b*. The frustoconical slope 31*b* slopes at a constant angle from the circular floor 31*a* up to the gear teeth 34 at a periphery of the gear block 30. Ribbing 38 extends across the top surface 31 in planes perpendicular to the circular floor 31*a*. Preferably, the ribbing 38 has a height not greater than a height of the gear teeth 34 above the circular floor 31*a*. The ribbing 38 provides additional rigidity for the gear block 30. The posts 40 extend upward from either the circular floor 31*a* or the frustoconical slope 31*b*. Preferably, the ribbing 38 intersects with the posts 40, providing additional support to the posts 40. The primary purpose of the topographical contour is to reduce residence time in an injection mold by providing parts having substantially uniform thickness. Thus each part is formed as an integral mass of plastic because the part has been injection molded.

Holes 70 preferably pass through the circular floor 31*a* of the top surface 31 and through to the bottom surface 32. The holes 70 are preferably equally distant from an axially geometric center of the gear block 30 with four holes 70 provided through the circular floor 31*a*. The holes 70 provide additional visual interest while also allowing additional support for a mold which can form the gear block 30.

An attachment means of the bottom surface 32 is the hub 60. The hub 60 is a hollow cylindrical construct located in a center of the bottom surface 32 of the circular gear block 30. The hub 60 is integrally molded with the entire gear block 30 and extends downward perpendicularly from the bottom surface 32. The hub 60 has a plurality of slits 62 formed in a side wall 68 of the hub 60 in a plane perpendicular to the bottom surface 32. A lip 64 is formed on an end of the hub 60 opposite the bottom surface 32 which extends radially outward from the side wall 68.

The hub 60 is of similar diameter and length to a prominence 160 of the support blocks 110 allowing connections as shown in FIG. 11. Thus, the hub 60 may fit within an orifice 170 of the support blocks 110. The hub 60 may also attach over a post 40 with a hollow interior 66 thereof surrounding the post 40. This allows the hub 60 and attached gear block 30 to be held by a user and impart rotational motion to a post 40 forced on another gear block 30.

The orifices 170 of the support blocks 110 are configured to support both the hubs 60 of the gear blocks 30 and the prominences 160 of the support blocks 110. Each orifice 170 is a substantially cylindrical opening formed in a side surface 116 of the support block 110. The orifice 170 includes a cylindrical side wall 172 extending into the support block 110 to an interior opening 174 defining a maximum depth of the orifice 170. Undulations 176 are formed on the cylindrical side wall 172 of the orifice 170.

The undulations 176 are configured to match ribs 166 formed on a cylindrical surface 162 of the prominences 160.

The cylindrical surface 162 of the prominences 160 are sized to be slightly lesser in diameter than a diameter of the cylindrical side wall 172 of the orifice 170. Thus, when the prominence 160 is placed within the orifice 170 the prominence 160 is tightly held therewithin in one of a variety of radially distinct orientations and prevented from rotation by interaction of the ribs 166 with the undulations 176.

The side wall 68 of the hub 60 is sized to also be slightly lesser in diameter than a diameter of the cylindrical sidewall 172. However, the sidewall 68 is smooth and is thus permitted to rotate freely when located within the orifice 170.

The lip 64 of the hub 60 fits into the orifice 170 through deflection of the sidewalls 68 together, facilitated by the slit 62. The side wall 172 of the orifice 170 is slightly shorter than a length of the hub 60. When the hub 60 is placed within the orifice 170, the lip 64 resides beyond the side wall 172, and beyond the interior opening 174, thus retaining the hub 60 within the orifice 170 in a way similar to that of the prominence 160. The hub 60 is restrained from axial translation because the lip 64 has a diameter greater than a diameter of the orifice 170. When the lip 64 is located beyond the interior opening 174 the lip 64 is free from the sidewall 172 and thus does not inhibit gear block 30 rotation. In this manner, a gear block 30 may attach to a support block 110 in a manner allowing rotation but restricting axial translation.

The gear block 30 has a plurality of beveled gear teeth 34 integrally formed with the side surface 33. Each tooth 34 extends radially outwardly from the side surface 33 to a tip **34*e*. The teeth 34 are separated from each other by a uniform distance such that gaps 35 between the teeth 34 are similar in width to the width of the teeth 34. This allows adjacent gear blocks 30 to mesh in driving relation. Each tooth 34 is beveled along a beveled tip 34*f* extending between the tip 34*e* and a bottom wall 34*d* of the tooth 34. The beveled tip 34*f* is preferably beveled at an angle $\alpha$, with respect to the bottom surface 32. Preferably the angle $\alpha$ is 45°, such that two similar gear blocks 30 can enmesh when in perpendicular relationship. However, so long as the tip 34*f* is angled at an oblique angle, the gear blocks 30** can enmesh in a non-parallel relationship.

More specifically, the gear teeth 34 each include a top wall **34*a* parallel to and spaced from the bottom wall 34*d*. The top wall 34*a* of each gear tooth 34 is preferably coplanar with other top walls 34*a* of adjacent gear teeth 34. The bottom wall 34*d* of each gear tooth 34 is preferably coplanar with the bottom surface 32 of the gear block 30. The top wall 34*a* extends radially outwardly away from a center of the gear block 30 to a tip 34*e*. This tip 34*e* is preferably oriented perpendicularly to the top wall 34*a* and extends downwardly therefrom. A lower extent of the tip 34*e* transitions into the beveled tip 34*f*. The bottom wall 34*d* extends radially outward away from a geometric center of the gear block 30 until it transitions into the beveled tip 34*f*. Thus, the beveled tip 34*f* extends from the tip 34*e* to the bottom wall 34*d***.

Figure 1:
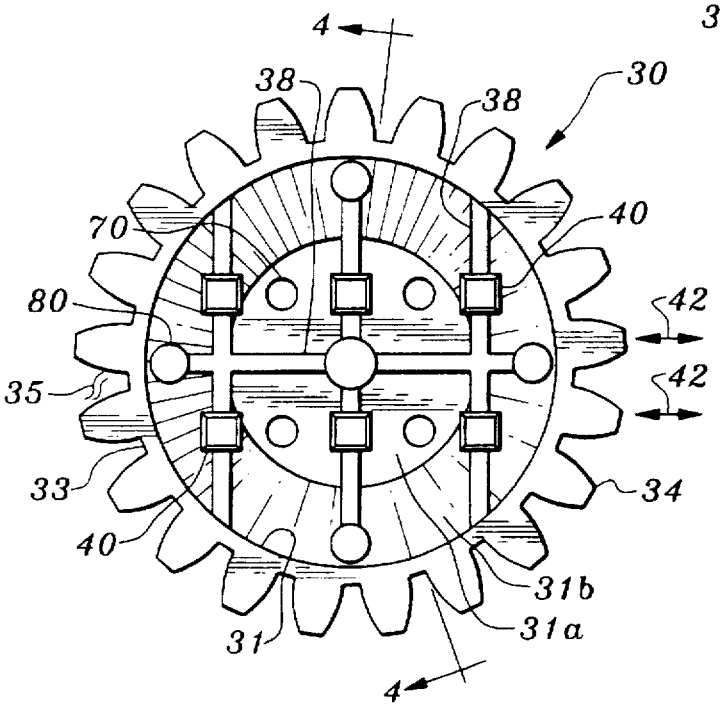
FIG. 1 is a top plan view of the gear block of this invention.
Figure 2:
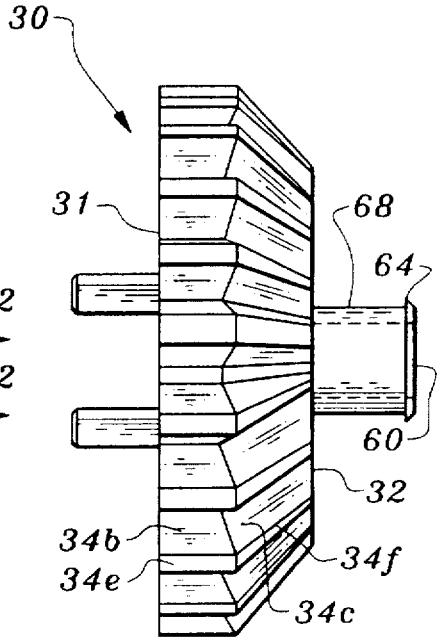
FIG. 2 is a side view of that which is shown in FIG. 1.
Figure 3:
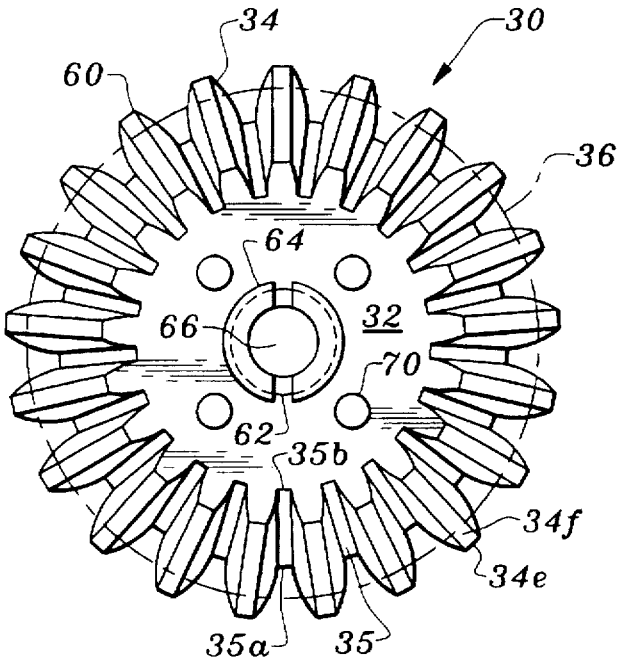
FIG. 3 is a bottom view of that which is shown in FIG. 1.
Figure 4:
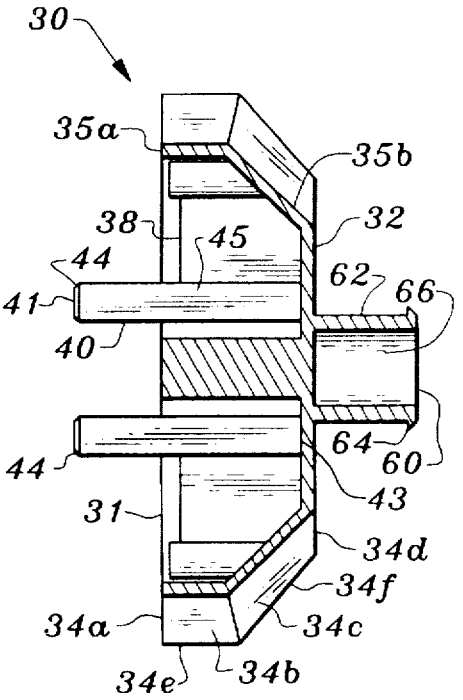
FIG. 4 is a sectional view taken along lines 4—4 of FIG. 1.

Each gear tooth 34 is bounded on each side by a sidewall **34*b*. The sidewall 34*b* is preferably a wall which is oriented vertically and which extends down from the top wall 34*a*. Preferably the sidewall 34*b* is not planar, but rather exhibits a slight curve which provides the gear teeth 34 with an appearance similar to that commonly exhibited by gear teeth as shown in FIG. 1. Specifically, the sidewalls 34*b* provide the teeth 34** with a truncated isosceles triangle shape which has sides which bend slightly toward each other as they extend.

The sidewalls **34*b* each extend from the gap 35 out to the tip 34*e*. A lower extent of each sidewall 34*b* transitions into a beveled wall 34*c* which extends from the gap 35 to the beveled tip 34*f*. The gap 35 includes a top edge 35*a* oriented between the top wall 34*a* of adjacent gear teeth 34 and a bottom edge 35*b* which is oriented between adjacent bottom walls 34*d* of adjacent gear teeth 34**.

In use and operation, the sidewalls **34*b* of the gear teeth 34 impact sidewalls 34*b* of an adjacent gear block 30 when the gear blocks 30 are oriented in a common plane as a spur gear pair. The beveled walls 34*c* of the gear teeth 34 impact beveled walls 34*c* of gear teeth 34 of an adjacent gear block 30 when two gear blocks 30** are oriented in a non-parallel relationship as a beveled gear pair.

Each gear block 30 is preferably of similar size and has teeth 34 of similar size such that two distinct gear blocks 30 may be placed adjacent to each other with the teeth 34 of the one gear block 30 fitting within the gap 35 of the other gear block 30. The two gear blocks 30 may interface in planes parallel to each other. They may also interface in two separate planes of the beveled gears 34. In this case, the angle between the two planes is equal to two times the angle $\alpha$ of each beveled gear 34 of each connected gear block 30.

Figure 6:
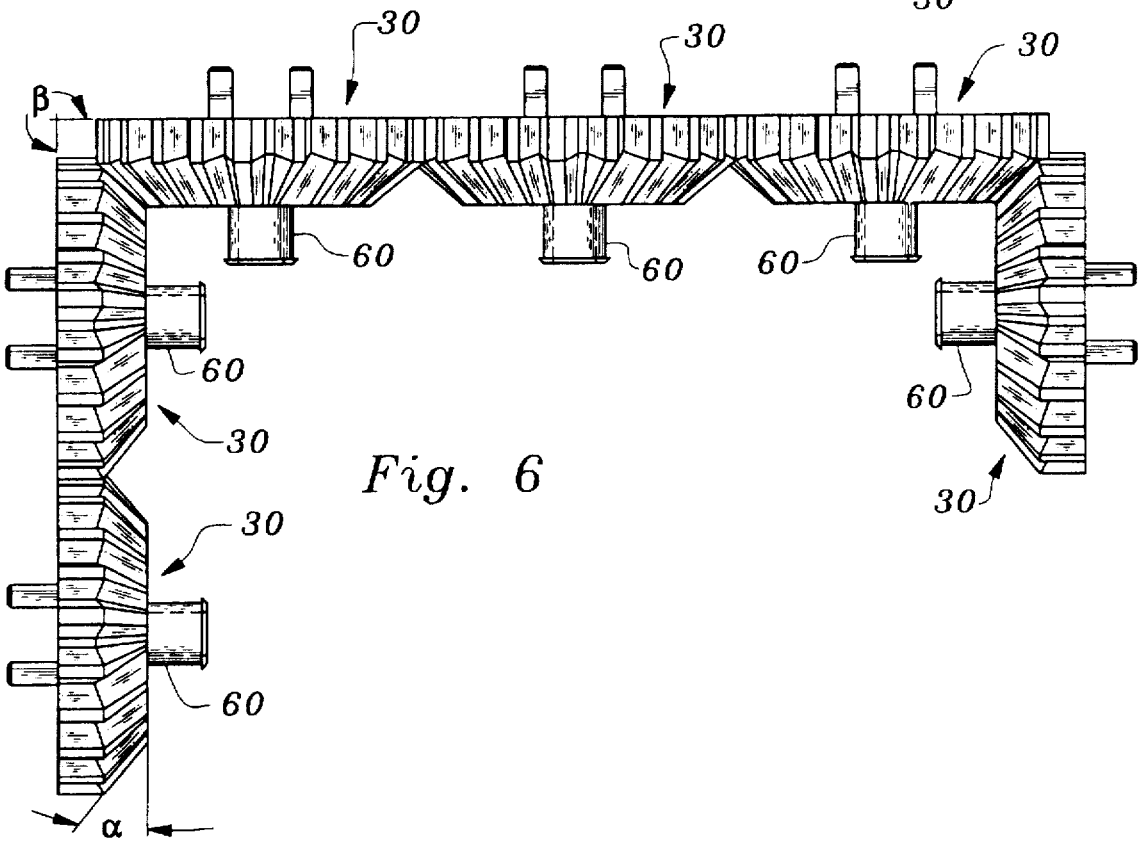
FIG. 6 is a side view of a plurality of gear blocks of this invention intermeshed together.
Figure 7:
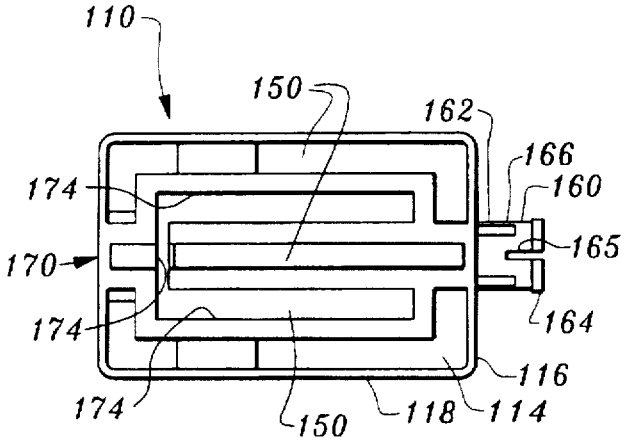
FIG. 7 is a bottom view of a support block which can rotatably support the gear block.
Figure 8:
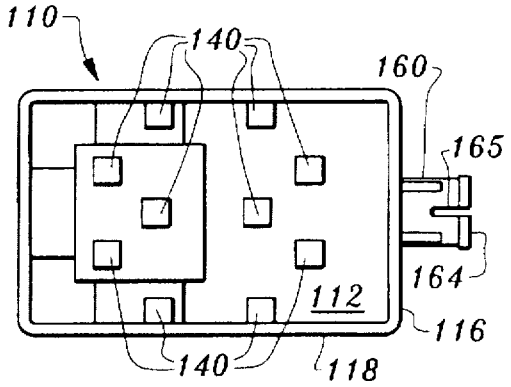
FIG. 8 is a top view of that which is shown in FIG. 7.
Figure 9:
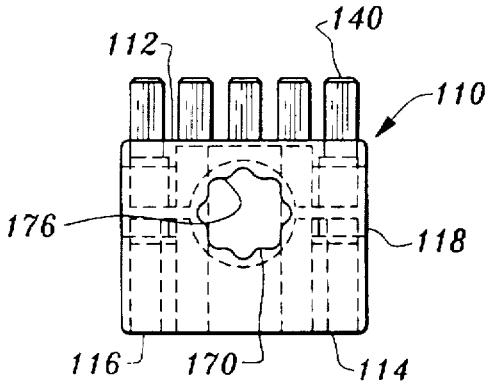
FIG. 9 is an end view of that which is shown in FIG. 7.
Figure 10:
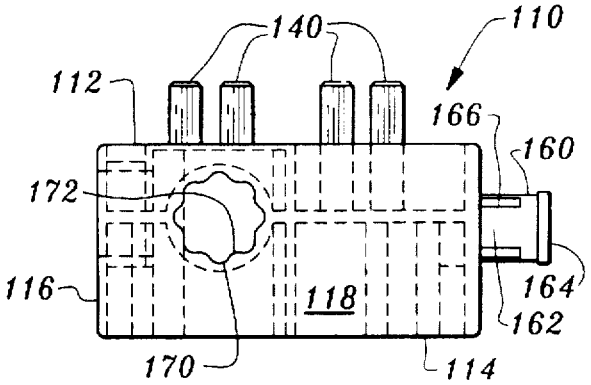
FIG. 10 is a side view of that which is shown in FIG. 7.

Preferably, the beveled angle $\alpha$ will be 45° causing the two planes to be orthogonal. This allows the two gears 30 to interface at right angles to each other, as shown in FIGS. 6 and 11. When an underlying support structure, such as one of the support blocks 110 has two perpendicular facets, the gears 30 can interface orthogonally while supported through the hubs 60 to the facets. In this situation, a reflex angle $\beta$ of approximately 270° is provided and the two gears interact over this reflex angle. Preferably the gears 30 are positioned so that the hubs 60 of each gear 30 extend toward a common point. When one interfacing gear block 30 is rotated, the other interfacing gear block 30 is caused to rotate. This action helps the user of the invention to better grasp the function of many mechanical devices.

Figure 5:
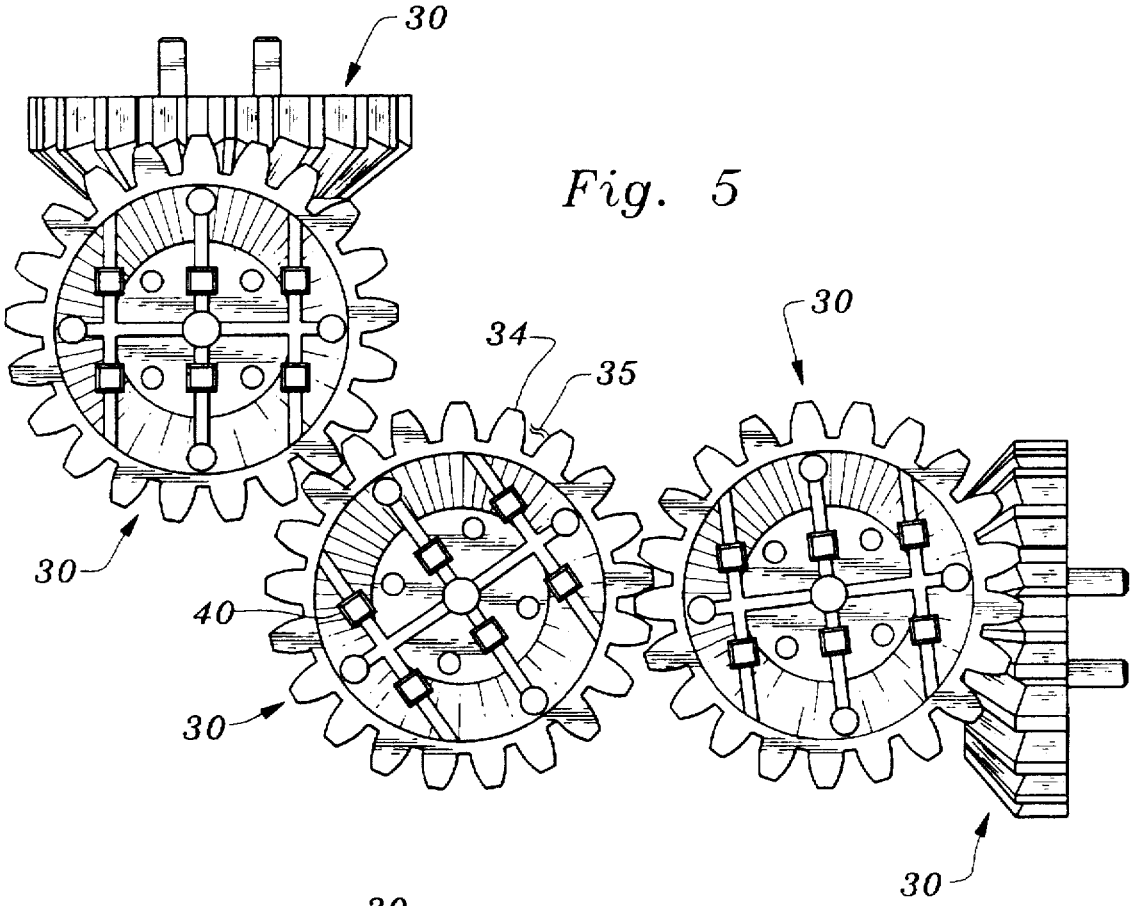
FIG. 5 is a top plan view of an assembly of gear blocks of this invention intermeshed together.

The orifices 170 supporting hubs 60 of the gear blocks 30 are located on the primary blocks strategically to maximize a number of possible block 30, 110 arrangements. Specifically, the support block 110 preferably includes an orifice 170 on one short side surface 116 and a prominence 160 on the opposite side surface 116. Long side surfaces 118 also include orifices 170 located a distance from an edge thereof similar to a radius of a pitch circle 36 of the gear block 30. The support block 110 can be stacked with posts of the top surface 112 connected within channels 150 of the bottom surface 114 of an adjacent support block 110. A height of the support blocks 110 is a whole fraction of a radius of the pitch circle 36 so that multiple gear blocks 30 can easily intermesh vertically as shown in FIG. 5. The support blocks 110 can also be connected end to end with the prominence 160 as shown in FIG. 11.

The gear blocks 30 can be interconnected as a set including gear blocks rotating about three axes, each axis perpendicular to the two other axes (FIG. 5). This flexibility allows the gear blocks 30 to exhibit gear interaction in three dimensional space.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A construction toy comprising, in combination:

a plurality of construction blocks having multiple facets, said construction blocks including a gear block, one said facet on one said gear block having gear teeth with means to mesh both in a planar fashion and an orthogonal fashion with gear teeth on another said gear block having similar meshing means, said gear block rotatable about an axial geometric center of said gear block, means for retarding axial translation of said gear block along said axial geometric center, said means for retarding axial translation including a cylindrical hub integrally formed with said gear block, and extending axially from an axial geometric center of said gear block, wherein said hub includes a lip extending radially outwardly from an outer surface of said hub said lip retarding axial translation through interaction with a lip retention means in a cylindrical hub receiving orifice separate from said gear block and formed in another said construction block, whereby said gear block is restrained from axial translation while being allowed to freely rotate, wherein said orthogonal meshing means is said gear teeth having a side closest to said hub which is beveled and which continues from said one facet onto a second facet including said hub, such that when two said gear blocks interface orthogonally through said beveled side of said gear teeth, said hub of each said gear block extends toward a common point, wherein a third facet on a side of said gear block opposite said second facet includes a plurality of posts extending orthogonally therefrom, said posts providing a means for said gear block to attach to other structures in a manner preventing relative rotation therebetween, wherein said posts are oriented in two parallel rows, each said post having a similar construction, wherein said posts include a tip which is beveled around a periphery thereof, said beveled tip assisting said post in easily passing within channels of other structures having a width similar to a width of said post, and wherein said posts are square in cross-section and wherein said two rows of said posts are spaced apart from other said posts in a common said row by a distance similar to a distance between two said posts within adjacent said rows, whereby two adjacent said posts from a common said row can be connected to a support structure in a manner similar to two adjacent said posts from different said rows.

2. A toy gear block for use in learning the mechanical operation of gears, the gear block formed from a unitary substantially rigid mass and comprising in combination:

a circular top surface, a circular bottom surface substantially parallel to and spaced from said top surface, a side surface interposed between said top surface and said bottom surface, said side surface including a plurality of gear teeth thereon, a hub integrally formed with said gear block and extending substantially perpendicularly from said bottom surface at a geometric center of said gear block, wherein said teeth include a beveled surface thereon oriented obliquely with respect to said top surface and said bottom surface, wherein said bottom surface is smaller than said top surface, wherein said hub includes a cylindrical sidewall defining a periphery thereof, wherein said hub includes a retention lip at an end thereof distant from said bottom surface, said retention lip extending radially outwardly from said hub, and wherein said hub includes a hollow interior, said hub including slits passing through a portion of said hub distant from said bottom surface, allowing said hub to be deflected somewhat into a lesser diameter, whereby said hub can be deformed to pass into an appropriately sized cylindrical orifice with said retention lip engaging the orifice to maintain said gear block within the orifice, wherein said teeth include a surface adjacent and perpendicular to said top surface, said perpendicular surface adjacent said beveled surface of said teeth at an end of said perpendicular surface distant from said top surface, whereby said gear blocks can perform adequately both as radial gears and as beveled gears, wherein said top surface has a connecting means thereon facilitating connection of structures to said top surface of said gear block, and wherein said top surface connecting means includes a plurality of posts extending perpendicularly from said top surface, said posts arranged in a plurality of rows, each said post having a square cross-section.

3. The gear block of claim 2 wherein gaps are provided between adjacent said teeth, said gaps including a perpendicular surface perpendicular to said top surface and adjacent said top surface and a beveled surface oblique with respect to said perpendicular surface and said bottom surface and interposed between said bottom surface and said perpendicular surface.

4. The gear block of claim 3 wherein said beveled surface of said gaps and said beveled surface of said teeth are beveled at an angle diverging 45 degrees from a plain including said bottom surface, whereby said gear block can interact with a similar gear block adjacent thereto with the two blocks oriented with top surfaces and bottom surfaces thereof perpendicular to each other.

5. A plurality of similar beveled gear blocks configured to interact while rotationally supported upon adjacent facets of a reflex angle of a structure, the interaction resulting in rotation of one gear block being transferred to an adjacent gear block, each gear block comprising in combination:

a support surface including a hub extending therefrom and integrally formed therewith, said hub rotationally supporting said gear block upon a facet of the structure, a plurality of gear teeth on a side surface adjacent said support surface, said gear teeth including a beveled surface thereon, said beveled surface adjacent said support surface and diverging from a plane including said support surface by an angle less than 90 degrees, and a top surface opposite said support surface, said top surface having a portion thereof closer to said plane including said support surface than a portion of said beveled surface is to said plane, wherein said top surface includes a circular floor oriented in a plane parallel to said support surface and closer to said plane including said support surface than a portion of said beveled surface is to said plane, wherein said top surface includes a frusto-conical slope substantially parallel to said beveled surface, and wherein posts extend from said floor of said top surface and beyond a maximum extent of said gear teeth from said plane including said support surface.

* * * * *